United States Patent [19]

Hankin

[11] 4,070,887

[45] Jan. 31, 1978

[54] ROLL FORMER FOR TUBE MILL

[75] Inventor: Ralph L. Hankin, Manito Beach, Mich.

[73] Assignee: Tube Machinery Corporation, Holland, Ohio

[21] Appl. No.: 737,553

[22] Filed: Nov. 1, 1976

[51] Int. Cl.[2] ..... B21D 22/10

[52] U.S. Cl. ..... 72/52; 113/58; 228/17.5

[58] Field of Search ..... 72/51, 52, 179, 181; 113/54, 55, 58, 116 UT; 93/82, 77 R; 29/819; 228/17, 17.5

[56] References Cited

U.S. PATENT DOCUMENTS

| | | | |
|---|---|---|---|
| 2,371,209 | 3/1945 | Anderson | 72/181 X |
| 2,444,463 | 7/1948 | Nordquist | 228/17 X |
| 3,361,320 | 1/1968 | Bobrowski | 228/17 |

*Primary Examiner*—Leon Gilden

*Attorney, Agent, or Firm*—Oliver E. Todd, Jr.

[57] ABSTRACT

An improved roll former for imparting a predetermined symmetrical curve to an advancing elongated metal strip in a tube mill. The roll former includes two identical rollers, each having a contoured surface for contacting and shaping one half of the metal strip. Each roller is mounted on a shaft which extends substantially perpendicular to a form radius in a central region of the section being formed by such roller. The shafts are mounted for simultaneous pivotal adjustment in both the same direction about a point and in opposite directions about such point to compensate for camber in the strip and to receive different sized rollers.

7 Claims, 7 Drawing Figures

ROLL FORMER FOR TUBE MILL

BACKGROUND OF THE INVENTION

This invention relates to metal deforming, and more particularly, to deforming a flat metal strip into a round tube by sequentially passing such strip between spaced pairs of shaped rollers.

Mills are well known in the prior art for producing welded metal tubes. The mills typically include a series of pairs of driven and idler rollers which, while advancing an elongated flat metal strip, impart an increasing curvature to such strip to form a tube. After forming, the tube passes through a welder which heats the edges of the strip and forges such edges together to form a continous welded tube. The welded tube is then cooled, passed through a sizer to impart a final round shape and then cut into preselected lengths. In the past, the idler rollers in each pair, which initially shape the flat metal strip into a curved tube, have been mounted on two spaced parallel shafts. The two shafts are adjustable towards and away from one another and may be raised and lowered to position the idler rollers for alignment to receive the advancing metal strip therebetween Each idler roller in a pair imparts one half of a predetermined symmetrical curve to the metal strip. The idler roller includes a lower surface area which extends to substantially the center of the advancing metal strip and an upper surface area which contacts an edge of the advancing metal strip. Since the rollers rotate about parallel vertical shafts, the lower surface area of each roller has an appreciably larger diameter from the center of rotation than the upper surface area. As a consequence, the surface speed of the smaller diameter upper surface area of the roller contacting the edge of the metal strip is appreciably lower than the surface speed of the larger diameter lower surface area of the roller which contacts the center of the strip. This speed differential is highly undesirable since it causes a scouring effect adjacent the center of the strip which in turn produces scuff marks on the finished tube and, also, it causes a distortion in the form of edge stretch on the metal strip. The high surface speed differential between different portions of the roller and the metal strip results in considerable energy loss. Thus, a higher powered motor is required to advance the metal strip between the pairs of idler rollers than is required merely for the shaping operation. In addition, the surface speed differential causes considerable wear on the rollers which shortens the life of the rollers. Since the lower surface area of the roller is of a relatively large diameter, the cost of manufacturing the roller is high. Therefore, it is desirable to design a roll former for use in a tube mill which is more efficient over prior art roll formers.

SUMMARY OF THE INVENTION

According to the present invention, an improved roll former is provided for use in a tube mill of the type in which a flat elongated sheet of metal is formed into a tube and the edges of such formed sheet are welded together. The roll former includes two identical symmetrical rollers which are mounted on skewed shafts. The two shafts are mounted in a plane extending perpendicular to the path along which the metal strip is advanced during forming. Each roller is contoured to impart one half of a symmetrical curvature to the advancing strip of metal. The shaft on which each roller is mounted extends substantially perpendicular to a form radius in the central region of the curve half being formed by the roller mounted on such shaft. As a consequence, the change in diameter in the roller between a lower point which contacts the metal strip near its center and an upper point which contacts an edge of the metal strip is minimized. This in turn minimizes the cost of manufacturing the roller since the maximum diameter of the roller can be reduced while maintaining the required surface contour, and minimizes surface speed changes along the roller to in turn reduce scuff marks on the surface of the metal strip and frictional wear on the roller. By reducing friction between the rollers and the advancing metal strip, the power required to advance the metal strip through the tube mill also is reduced.

The two shafts for a pair of rollers are mounted in a support stand for adjustment to receive different sized rollers. The angles of the shafts are simultaneously adjusted to pivot the shafts oppositely about a point in their mounting plane towards or away from one another for smaller or larger diameter rollers. In addition, the shafts are mounted to pivot or rotate together about the point to compensate for camber or edge curvature in the elongated strip of metal. Prior art roll formers are not readily adjustable to compensate for camber along the length of the metal strip.

Accordingly, it is an object of the invention to provide an improved roll former for use in a tube mill.

Another object of the invention is to provide an improved roll former for a tube mill which reduces the power required to operate such mill.

Still another object of the invention is to provide an improved roll former for a tube mill which is readily adjustable for use with different sized rollers.

Another object of the invention is to provide a roll former for a tube mill in which surface speed variations between forming rollers and an advancing metal strip are minimized.

Another object of the invention is to provide an improved roll former for a tube mill in which each roll applies a forming force substantially perpendicular to the section being formed.

Other objects and advantages of the invention will become apparent from the following detailed description, with reference being made to the accompanying drawings.

DESCRIPTION OF THE PREFERRED EMBODIMENT

Figure 1A:
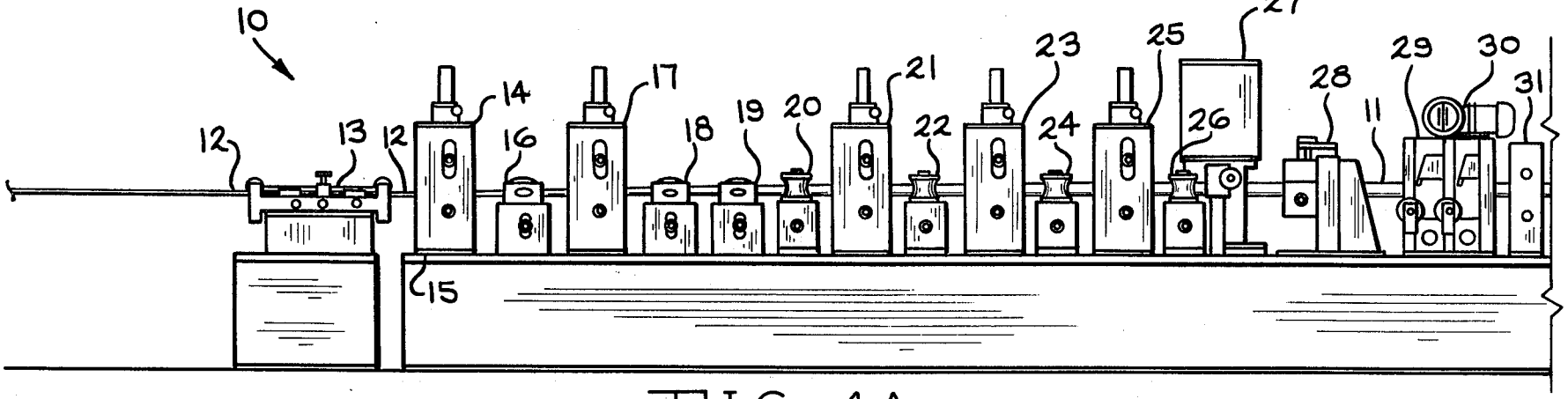
FIG. 1, consisting of FIGS. 1A and 1B, is a side elevational view of a tube mill for forming a tube from an elongated strip of metal.
Figure 1B:
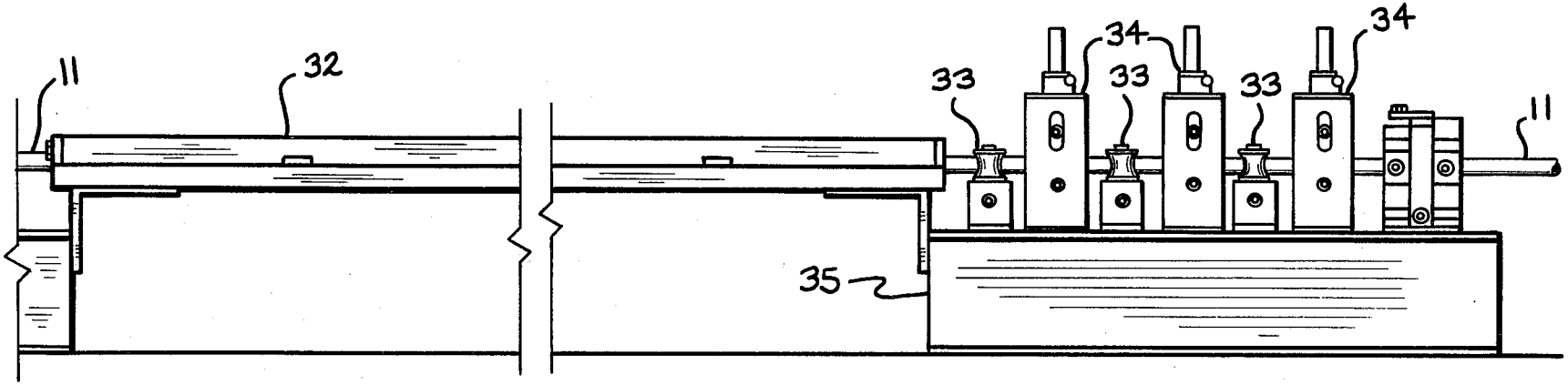

Referring first to FIG. 1 of the drawings, which is separated into FIGS. 1A and 1B, a tube mill 10 is shown for manufacturing a continuous welded tube 11 from a flat elongated strip of metal 12. The metal strip 12 is supplied from a suitable source (not shown) and is preferably supplied from a dynamic storage system as a continuous strip for forming a continuous tube 11. The metal strip 12 initially passes through an entry guide 13 which engages and guides the edges of the flat metal strip 12. From the entry guide 13, the metal strip 12 is drawn through a first breakdown 14 mounted on a forming stand 15. The first breakdown 14 includes a pair of driven rollers mounted on horizontal shafts. The strip 12 is advanced by pinching between the driven rollers and, simultaneously, a slight contour is imparted to it by the rollers. From the first breakdown 14, the metal strip 12 passes through an idler roll former 16 which further shapes the metal strip 12 and onto a second driven breakdown 17. From the second breakdown 17, the metal strip advances through two additional idler roll formers 18 and 19 and a side closer 20. The first breakdown 14, the idler roll former 16, the second breakdown 17, the idler roll formers 18 and 19, and the side closer 20 progressively contour or bend the strip 12 into a nearly round configuration. From the side closer 20, the strip 12 passes through an alternating series of driven fin rollers 21, 23, and 25 and three side closers 22, 24, and 26. The fin rollers 21, 23, and 25 are driven rollers which "squash" or press between the top and bottom of the tube to shape the tube in a vertical direction while the side closers 22, 24, and 26 exert side forces on the tube. The fin rollers 21, 23, and 25 each include in an upper roller (not shown) a fin which extends into the center of the tube for orienting the position of the tube opening as it enters a seam guide and welder 27. The welder 27 typically includes an induction heater for heating the adjacent edges of the formed strip 12 to welding temperatures. From the welder 27, the strip 12 passes through a unit 28 which exerts weld pressure on the sides of the tube for producing a continous forged weld along the adjacent edges. From the unit 28, the tube 11 passes through a scarfing unit 29 and bead winder 30 for removing excessive metal from the weld bead on the tube. The tube 11 then passes through a seam ironer 31 which forms a smooth interior surface on the tube 11 at the weld seam. From the seam ironer 31, the tube 11 passes through a cooling zone 32 wherein the tube 11 is cooled with a suitable liquid coolant. During the welding operation, the tube 11 is distorted in cross section. After cooling, the tube 11 is passed through an alternating series of side rollers 33 and top and bottom rollers 34 on a sizing stand 35 which impart a final round cross section to the tube 11. The tube 11 is then delivered to conventional apparatus (not shown) which measures and cuts the continuous tube 11 into predetermined lengths.

Figure 2:
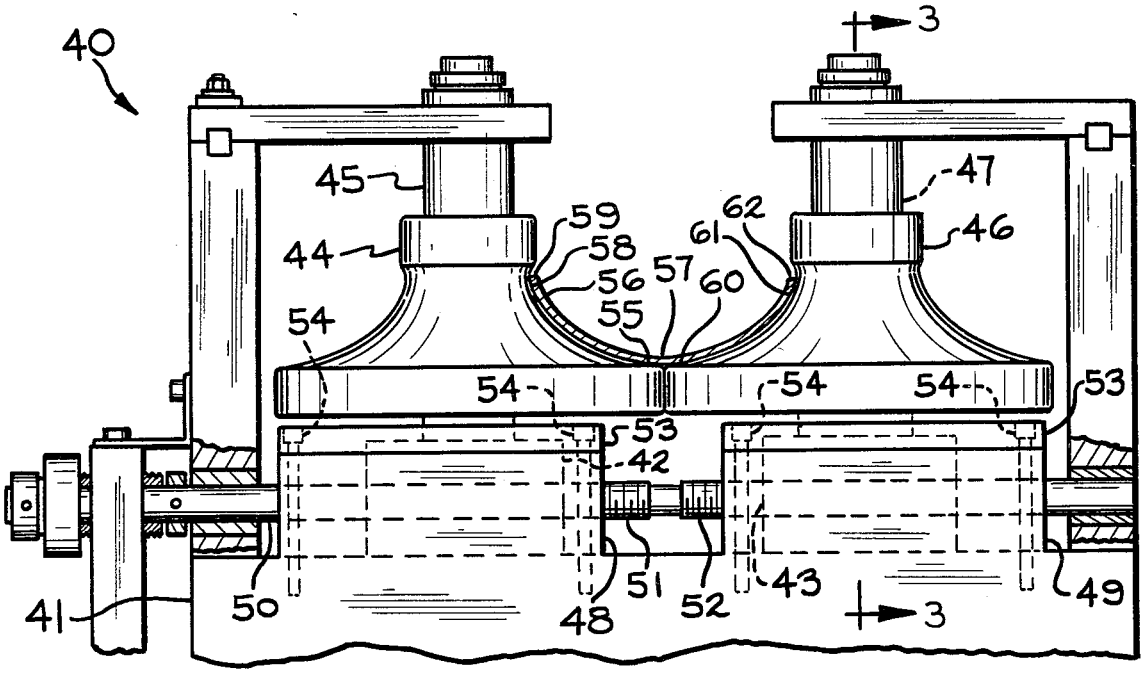
FIG. 2 is a fragmentary side elevational view partially broken away, showing a prior art roll former for use in a tube mill.
Figure 3:
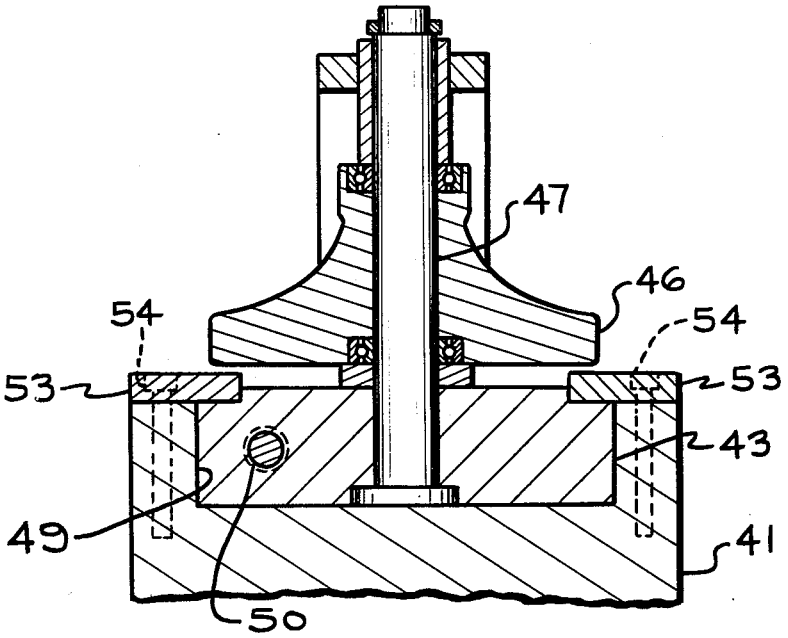
FIG. 3 is a cross sectional view taken along line 3—3 of FIG. 2.

Turning to FIGS. 2 and 3, a fragmentary section is shown of a typical prior art idler roll former 40. The prior art idler roll former 40 is used for bending an advancing metal strip in a tube mill, and has been used as the roll formers 16, 18, and 19 in the tube mill 10 of FIG. 1. The roll former 40 includes a support stand 41 on which two carriages 42 and 43 are mounted. A roller 44 is mounted on a vertical shaft 45 extending above the carriage 42 and a roller 46 is mounted on a vertical shaft 47 extending above the carriage 43. The carriages 42 and 43 are guided in channels 48 and 49, respectively, for linear movement towards and away from one another. The actual position of the carriages 42 and 43 is determined by an adjustment screw 50. The adjustment screw 50 includes a threaded section 51 which engages the carriage 42 and a threaded section 52 which engages the carriage 43. The section 51 and 52 are threaded in opposite directions so that rotation of the screw 50 in one direction simultaneously moves the carriages 42 and 43 linearly towards one another and rotation of the screw 50 in the opposite direction simultaneously moves the carriages 42 and 43 linearly away from one another. After the position of the carriages 42 and 43 is adjusted for a particular pair of rollers 44 and 46, the carriages 42 and 43 are locked in place by means of plates 53 and screws 54 which pass through the plates 53 and threadably engage the channels 48 and 49. Other conventional means (not shown) are provided for vertically and horizontally adjusting the position of the rollers 44 and 46 for alignment with the path along which a metal strip advances in the tube mill in which the roll former 40 is operated.

The two rollers 44 and 46 extend symmetrically about their respective shafts 45 and 47. The roller 44 includes a lower surface area 55 having a predetermined large diameter for contacting and shaping a strip of metal 56 adjacent its center 57. The roller 44 also has a predetermined small diameter upper surface area 58 which contacts and shapes an edge 59 of the strip 56. Similarly, the roller 46 has a predetermined large diameter lower surface area 60 which contacts the metal strip 56 adjacent its center 57 and a small diameter upper surface area 61 which contacts and shapes an edge 62 of the metal strip 56. Each of the two rollers 44 and 46 is contoured to impart one half of a predetermined curve to the metal strip 56. However, it should be appreciated from viewing FIG. 2 that the rollers 44 and 46 have several disadvantages. The major problem is caused by the large variation in the diameter of the contoured roller surfaces between the large diameter areas 55 and 60 and the small diameter areas 58 and 61. The substantial change in diameter causes an even greater difference in the surface speeds in the portions of the rollers 44 and 46 contacting the edges 59 and 62 of the strip 56 versus the portion of the rollers 44 and 46 contacting the center 57 of the strip 56 since the circumference of any point on the rollers 44 and 46 equals pi times the diameter. The large surface speed difference and the fact that the rollers 44 and 46 rotate about parallel, vertical shafts 45 and 47 results in stretched, wavy edges on the shaped metal strip 56 and frequently causes scouring at the bottom center 57 of the strip 56. On light gauge metals, a creasing may occur along the center 57 of the metal strip 56.

It will be noted also, from FIG. 2, that as the metal strip 56 is shaped into a tube, the edges 59 and 62 are lifted by sliding vertically along the rollers 44 and 46 while the center 57 is not displaced. In order to provide the required vertical force component for lifting the edges 59 and 62, a considerably greater horizontal force is required. This places undue stresses on the vertical shafts 45 and 47 and the rollers 44 and 46 and also increases wear on these components. The high horizontal forces exerted between the rollers 44 and 46 and their respective shafts 45 and 47 and frictional energy losses due to surface speed variations and sliding between the rollers 44 and 46 and the metal strip 56 require considerable power for pulling the metal strip 56 through the prior art idler roll former 40. Although FIG. 2 shows the strip 56 in circumferential contact with the rollers 44 and 46, this is generally not the case with prior art roll formers 40. The surface speed variations between the strip 56 and the rollers 44 and 46 and the vertical sliding of the strip edges 59 and 62 on the rollers 44 and 46 typically results in only the edges 59 and 62 and the center 57 of the strip 56 contacting the rollers 44 and 47. This point contact increases stresses in the strip 56.

The present invention is directed to an improved idler roll former which eliminates many of the disadvantages of the prior art roll former 40 shown in FIGS. 2 and 3. The principle of the present invention is best demonstrated by the "flower" diagram of FIG. 4 which diagrammatically shows the progressive steps through which a flat metal strip 66 is shaped into a round tube 67. The ends of the metal strip 66 are represented by dots designated with the reference numbers 68 and 69. As the strip 66 successively passes through rollers for shaping, the successive strips are designated by the reference numbers **66*a* through 66*f* and the ends of the strip are designated with the reference numbers 68*a* through 68*f* and 69*a* through 69*f*. The different stages through which the flat metal strip 66 is formed are exemplary of the contours imparted to the metal strip 12 by the different forming devices shown in the first portion of the tube mill 10 of FIG. 1A. The first breakdown 14 bends the flat metal strip 66 to the configurations shown at 66*a*. The idler roll former 16 then further lifts the edges to the points 68*b* and 69*b* and imparts the predetermined contour 66*b* to the metal strip. The second breakdown 17 further bends the strip to the contour 66*c*, the idler roll formers 18 and 19 bend the strip to the contours 66*d* and 66*e*, respectively, and the side closer 20 finally bends the metal strip to the configuration shown by the contour 66*f*. Final shaping before the strip enters the seam welder 27 is not shown in the "flower" diagram of FIG. 4**.

Figure 4:
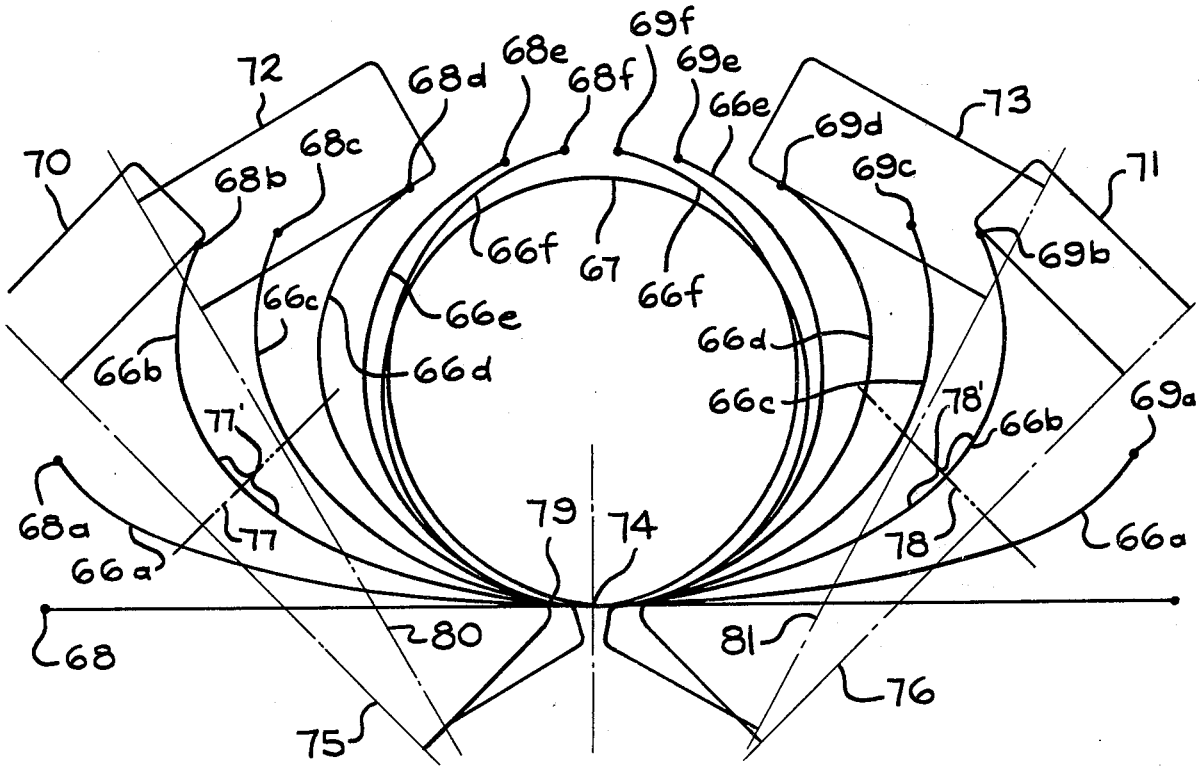
FIG. 4 is a "flower" diagram showing typical stages through which a flat elongated sheet of metal is folded into a tube.

The basic concept of the present invention is illustrated in FIGS. 4 by a first pair of rollers 70 and 71 and a second pair of rollers 72 and 73. For simplicity, only one half of each roller 70–73 is shown in FIG. 4. In practice, the first pair of rollers 70 and 71 would be mounted at the location of the idler roll former 16 and the second pair of rollers 72 and 73 would be mounted at the location of the idler roll former 18 in the tube mill 10 of FIG. 1. The first pair of rollers 70 and 71 shape the metal strip 66 from the predetermined contour **66*a* to the predetermined contour 66*b* and the second pair of rollers 72 and 73 shape the metal strip 66 from the predetermined contour 66*c* to the predetermined contour 66*d*. Each of the rollers 70 and 71 impart one half of the predetermined curve to the strip 66*b*, with the roller 70 imparting the curve from a center 74 of the metal strip 66 to the end 68*b* and the roller 71 imparting a curve from the center 74 to the end 69*b*. The rollers 70 and 71 rotate about skewed axes 75 and 76, respectively. The axis 75 extends approximately perpendicular to a form radius 77 in a central region 77' of the contoured surface on the roller 70, and the axis 76 extends approximately perpendicular to a form radius 78 in a central region 78' of the contoured surface on the roller 71. By skewing the axes 75 and 76 in such a manner, the rollers 70 and 71 are of minimum surface contour. In other words, the annular surface area about the roller 70 which forms the end 68*b* of the strip 66*b*, and a lower annular surface area 79 of the roller 70 which forms the strip 66*b* adjacent the center 74 are of substantially the same radii, and variations in the radii along the axis 75 of the roller 70 are minimized. By minimizing the changes in radius along the surface contour of the roller 70, variations in surface speed of the different portions of surface contour in contact with the strip 66*b* are also minimized. This in turn reduces frictional wear and scuff marks on the finished tube and on the roller 70 and also reduces the power required to pull the metal strip 66 between the rollers 70 and 71 to form such strip into the curved strip 66*b*. Furthermore, the forming pressure is substantially perpendicular to the axes 75 and 76 and is distributed evenly across the strip instead of at its edges, as in prior art rollers such as those shown in FIGS. 2 and 3. This in turn maintains complete surface contact between the strip 66 and the rollers 70 and 71, minimizes edge stretching of the strip 66 and minimizes stress and elongation in the strip 66. The rollers 72 and 73 are similarly mounted to rotate about axes 80 and 81, respectively, which extend substantially perpendicular to the form radii in central regions of such rollers 72 and 73**.

Figure 5:
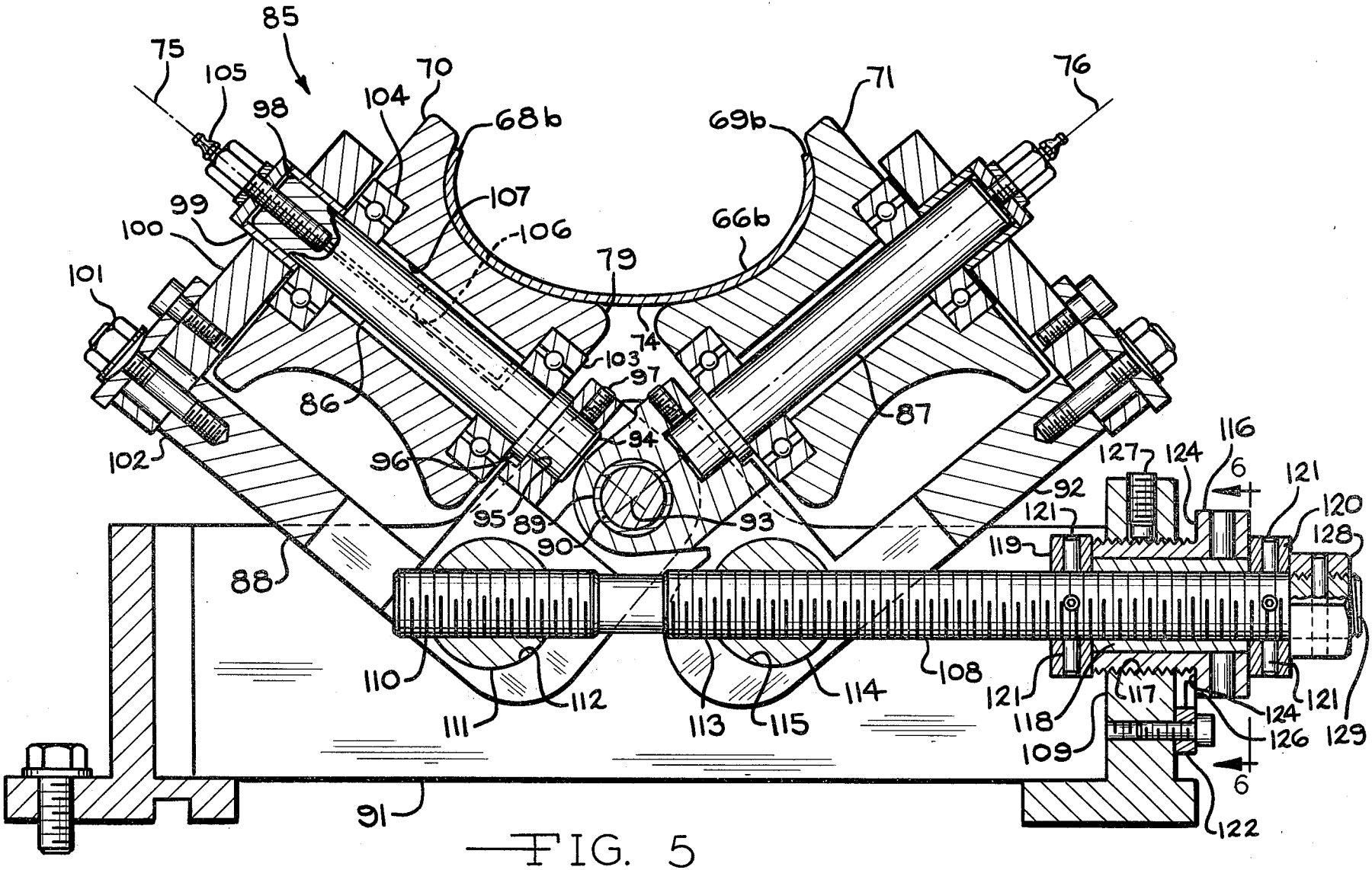
FIG. 5 is a cross sectional elevational view showing an improved roll former for a tube mill constructed in accordance with the present invention.

Turning now to FIG. 5, a cross sectional elevational view is shown of an improved roll former 85 constructed in accordance with the present invention for use in a tube mill, such as the tube mill 10 shown in FIG. 1, for imparting a predetermined symmetrical curve to an advancing elongated metal strip. The roll former 85 is shown mounting the two rollers 70 and 71 for shaping the curved strip **66*b*, as was discussed above under the description of FIG. 4. The roller 70 is mounted on a shaft 86 which is concentric with the roller axis 75, and the roller 71 is mounted on a shaft 87 which is concentric with the roller axis 76. The shaft 86 is mounted on a rigid metal bracket 88 which pivots on a bushing 89 on a pin 90. The pin 90 is in turn attached to a support stand 91. Similarly, the shaft 87 is mounted on a bracket 92 which also pivots on the bushing 89 and the pin 90. The pin 90 is spaced below and extends parallel to the center 74 of the advancing metal strip 66*b*. Preferably, the spacing between the pin 90 and the strip center 74 is kept to a minimum. The brackets 88 and 92 mount the shafts 86 and 87, respectively, in a plane extending perpendicular to the shaft 90 and to the advancing metal strip 66*b* with the axes 75 and 76 of the shafts 86 and 87 intersecting the shaft 90 at its center 93. As a consequence, the shafts 86 and 87 extend radially outwardly from the center 93 of the shaft 90, regardless of the position to which the brackets 88 and 92 are pivoted on the shaft 90**.

The shaft 86 has a lower end 94 which extends into an opening 95 in the bracket 88 until a shoulder 96 on the shaft 86 abuts the bracket 88. The shaft 86 is held in place by means of a set screw 97 threaded into the bracket 88. The shaft 86 has a second end 98 which extends through a bushing 99 mounted in a support arm 100. A bolt 101 attaches the support arm 100 to an end 102 of the bracket 88. Two bearings 103 and 104 are located between the roller 70 and the shaft 86 for rotatably mounting the roller 70. The shaft shoulder 96 and the bushing 99 restrain the bearings 103 and 104 and the roller 70 from axial movement on the shaft 86. A suitable grease fitting 105 is threaded into the end of the shaft 86 for supplying grease through passages 106 in the shaft 86, and an annular space 107 between the roller 70 and the shaft 86 to the bearings 103 and 104.

The shaft 87 and the roller 71 are mounted on the bracket 92 in the same manner in which the shaft 86 and the roller 70 are mounted on the bracket 88. An adjustment screw 108 extends from one end 109 of the support stand 91 to below the brackets 88 and 92. The adjustment screw 108 includes a threaded end section 110 which engages a cylindrical nut 111 rotatably mounted in an opening 112 in the bracket 88. A second threaded section 113 on the screw 108 engages a cylindrical nut 114 rotatably mounted in an opening 115 in the bracket 92. The two threaded sections 110 and 113 are oppositely threaded or, in other words, one of the sections 110 and 113 has left hand threads and the other section 113 and 110 has right hand threads. As a consequence, rotating the screw 108 in one direction causes the nuts 111 and 114 to move apart and rotating the screw 108 in the opposite direction, causes the nuts 111 and 114 to move together. As a screw 108 is rotated to move the nuts 111 and 114 apart, the brackets 88 and 92 are pivoted in opposite directions about the pin 90 to pivot the shafts 86 and 87 towards a vertical line extending through the center 93 of the pin 90 and the center 74 of the formed metal strip **66*b*. If the screw 108 is rotated in the opposite direction to move the nuts 111 and 114 together, the brackets 88 and 92 are pivoted about the pin 90 to move the shafts 86 and 87 towards a horizontal line through the center 93 of the pin 90. As a consequence of rotation of the screw, 108, the brackets 88 and 92 may be positioned for mounting different sized rollers on the shafts 86 and 87, such as the rollers 72 and 73 in FIG. 4, so that the roll former 85** is adaptable for use in various locations in a tube mill.

The strip 12 which enters the tube mill 10 shown in FIGS. 1A and 1B is typically supplied from a coil containing a long length of a flat metal strip. When the coil is unrolled and laid on a flat surface, a slight curvature or camber commonly exists when viewing the unrolled metal strip in plan. In prior art tube mills, it is very difficult to adjust the tube mill to compensate for camber in the elongated metal strip. Compensation for camber is important because the location of the metal seam in the formed tube is critical during welding. The roll former 85 shown in FIG. 5 is adjustable to compensate for camber in the metal strip by simultaneously rotating the rollers 70 and 71 in the same direction about the pin 90. As the rollers 70 and 71 are rotated together, the shortest edge **68*b* or 69*b* of the off-center formed strip 66*b* will tend to climb up its forming roller 70 or 71 to a center position on the rollers 70 and 71. The simultaneous pivotal adjustment of the rollers 70 and 71 on the pin 90 is achieved by means of a collar 116 threaded into an opening 117 in the support stand end 109. The screw 108 passes through a bushing 118 within the collar 116 and is free to rotate within such bushing 118. Two thrust bearings 119 and 120 are attached to the screw 108 by means of set screws 121. The thrust bearings 119 and 120 are positioned against opposite ends of the collar 116 to prevent axial movement of the screw 108 with respect to the collar 116. When the screw 108 is rotated in a predetermined direction, the screw 108 is moved axially to the left to rotate the shafts 86 and 87 and the attached rollers 70 and 71 simultaneously in a clockwise direction and, when the collar 116 is rotated in the opposite direction, the screw 108 is moved axially to the right to rotate the shafts 86 and 87 and the attached rollers 70 and 71 simultaneously in a counterclockwise direction. By rotating the rollers 70 and 71 simultaneously either clockwise or counterclockwise about the pin 90, the rollers 70 and 71 are positioned off-center for compensating for camber in the elongated metal strip during formation into the curve 66*b***.

Figure 6:
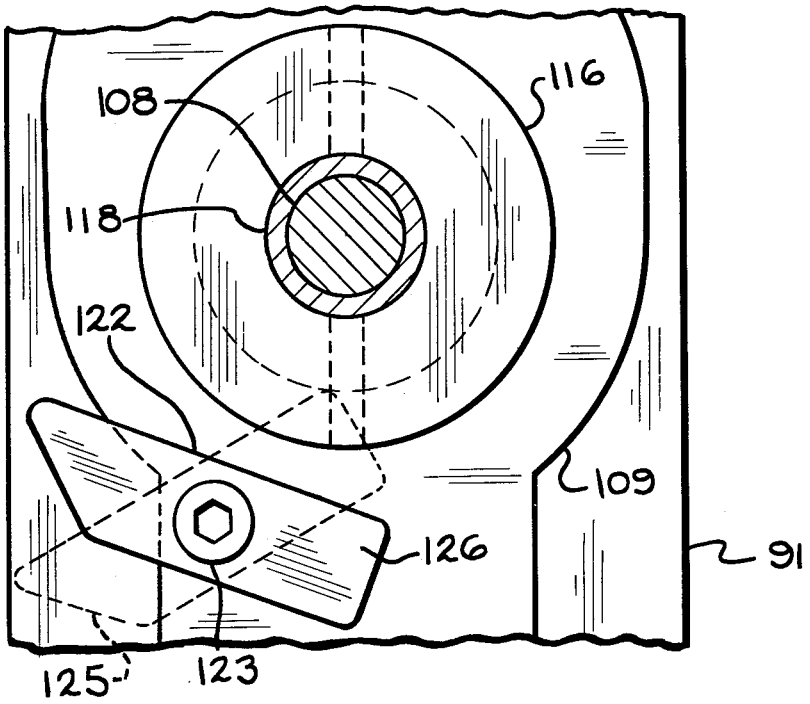
FIG. 6 is a fragmentary cross sectional view taken along line 6—6 of FIG. 5.

It is desirable to be able to easily return the rollers 70 and 71 to their centered position when the metal strip 66 is changed from one having camber to a straight strip. Therefore, a feeler gauge 122 is provided for recentering the rollers 70 and 71. As best seen in FIGS. 5 and 6, the feeler gauge 122 is mounted to pivot on a screw 123. The threaded collar 116 has an annular shoulder 124 which normally is spaced a predetermined distance from the support stand end 109. When the feeler gauge 122 is pivoted to the position shown by the dashed line 125 in FIG. 6, a flat end surface 126 extends under the annular shoulder 124 and is also spaced the predetermined distance from the support stand end 109. By rotating the collar 116 until the annular shoulder 124 contacts the feeler gauge surface 126, the rollers 70 and 71 will be positioned in a reference position with the axes 80 and 81 extending equally to either side of a line through the center 93 of the pin 90 and the center 74 of the metal strip **66*b*. After the collar 116 is rotated in the opening 117 to position the rollers 70 and 71, a set screw 127 threaded into the support stand end 109 is tightened against the collar 116** to prevent rotation thereof.

A nut 128 is pinned or otherwise attached to an end 129 of the screw 108 for use in rotating the screw 108 within the collar 116. By engaging the nut 128 with a conventional wrench (not shown) for rotating the nut 128 and the screw 108, the shafts 86 and 87 and their attached rollers 70 and 71 may be pivoted in opposite directions about the pin 90 without changing the setting of the collar 116 in the support stand end 109. As a consequence, the roll former 85 is completely adjustable for receiving different size rollers 70 and 71 requiring different angled axes 75 and 76 and is completely adjustable to compensate for camber in the elongated metal strip being formed into a tube. Through the use of rollers 70 and 71 which have axes 75 and 76 extending substantially perpendicular to a form radius through the central region of the contour being formed by such rollers, scuff marks on the tube surface normally resulting during the forming operation are substantially eliminated, there is more positive control of the strip 66 with less effort and virtually no distortion, there is a longer life for the rollers 70 and 71, the rollers 70 and 71 may be of a smaller diameter than prior art rollers and therefore cost less, and less power is required to advance the metal strip 66 through the rollers 70 and 71 during forming.

It will be appreciated that various changes and modifications may be made in the above described preferred embodiment of a roll former for use in a tube mill without departing from the spirit and the scope of the following claims. For example, screw 108 and the nuts 111 and 114 may be replaced with worm gears or with rack and pinion gears for positioning the shafts 86 and 87. Also, the shafts 86 and 87 may be eliminated and replaced with other pivotable supports which engage the rollers 70 and 71 only at the ends of the axes 75 and 76.

What we claim is:

1. In a mill for forming a tube from an elongated flat strip of metal, an improved roll former for imparting a predetermined symmetrical curve to such strip comprising, in combination, first and second shafts, means mounting said first shaft to pivot in a plane about a point in such plane, means mounting said second shaft in such plane to pivot about said point, adjustment means for simultaneously pivoting said shafts in such plane equally in opposite directions about said point whereby said shafts may be selectively pivoted towards and away from one another, a symmetrical first roller mounted to rotate on said first shaft about an axis of symmetry, and a symmetrical second roller mounted to rotate on said second shaft about an axis of symmetry, said first and second rollers each having contoured external surface means for imparting one half of the predetermined symmetrical curve to such strip when such strip is longitudinally advanced between said rollers.

2. An improved roll former for use in a tube mill, as set forth in claim 1, and further including adjustment means for simultaneously pivoting said shafts in such plane equally in the same direction about said point.

3. An improved roll former for use in a tube mill, as set forth in claim 1, wherein said first and second rollers each have a lower surface area adjacent said point for contacting and shaping such strip adjacent the center of the predetermined curve and an upper surface area spaced from said point for contacting and shaping an edge of such strip, said lower and upper surface areas on each roller having substantially the same diameters from the center of rotation of such roller.

4. An improved roll former for use in a tube mill, as set forth in claim 3, wherein each of said shafts extends in such plane substantially perpendicular to a form radius in a central region of the half of the predetermined symmetrical curve formed by such roller mounted on such shaft.

5. An improved roll former for use in a tube mill, as set forth in claim 1, wherein said first and second shafts are located in such plane at angles providing minimum contours on said first and second rollers.

6. In a mill for forming a tube from an elongated flat strip of metal, an improved roll former for imparting a predetermined symmetrical curve to such strip as such strip is advanced longitudinally through said roll former comprising, in combination, first and second symmetrical rollers each having a surface corresponding in contour to one half of the predetermined symmetrical curve, means mounting said first roller to rotate about a first axis, said first axis extending substantially perpendicular to a form radius in a central region of said contoured surface on said first roller, means mounting said second roller to rotate about a second axis, said second axis extending substantially perpendicular to a form radius in a central region of said contoured surface on said second roller, and means mounting said rotatable rollers with said first and second axes skewed with respect to a form radius at the center of the predetermined symmetrical curve for imparting such predetermined symmetrical curve to such strip when such strip is longitudinally advanced between said rollers including means for simultaneously pivoting said rollers in a plane perpendicular to the path along which such strip is advanced and about a point located in said plane immediately below the center of such advancing strip.

7. An improved former for imparting a predetermined symmetrical curve to an advancing elongated strip of metal comprising, in combination, first and second rollers each having an axis of symmetry and each having a surface corresponding in contour to one half of the predetermined symmetrical curve, said contoured surface on each roller having a minimum radii variation with respect to the axis of symmetry for such roller, means mounting said first roller to rotate about its axis of symmetry, means mounting said second roller to rotate about its axis of symmetry, said axes of symmetry lying in a plane perpendicular to the path of the advancing strip of metal and intersecting below the center of the advancing strip of metal, and adjustment means for simultaneously pivoting said first and second roller axis in the same direction in said plane about the point of intersection of said axes.

* * * * *